United States Patent [19]

Leupold

[11] Patent Number: 5,072,204

[45] Date of Patent: Dec. 10, 1991

[54] DIPOLE FOR MAGNETIC FIELD COMPENSATION

[75] Inventor: Herbert A. Leupold, Eatontown, N.J.

[73] Assignee: The United States of America as prespresented by the Secretary of the Army, Washington, D.C.

[21] Appl. No.: 714,424

[22] Filed: Jun. 12, 1991

[51] Int. Cl.[5] ..... H01F 7/02

[52] U.S. Cl. ..... 335/306; 335/298

[58] Field of Search ..... 335/209, 210, 211, 212, 335/214, 296, 297, 298, 301, 302, 304, 306, 285, 286, 287, 288, 295; 310/90.5; 315/5.34, 5.35

[56] References Cited

U.S. PATENT DOCUMENTS 3,223,898 12/1965 Bey ..... 335/306
4,758,813 7/1988 Holsinger et al. ..... 335/306
4,862,128 8/1989 Leupold ..... 335/306
4,994,778 2/1991 Leupold ..... 335/306

*Primary Examiner*—Leo P. Picard
*Assistant Examiner*—Ramon M. Barrera
*Attorney, Agent, or Firm*—Michael Zelenka; William H. Anderson

[57] ABSTRACT

A magnetic dipole of varying magnitude and orientation is disclosed wherein the dipole is comprised of an outer magnetic shell and an inner magnetic sphere which is rotatably mounted within the outer magnetic shell. Both the outer shell and the inner sphere are mode of magnetically rigid material and are each magnetized in a uniform direction parallel to a single longitudinal axis. The inner sphere is preferably rotated within the outer shell via a non-magnetic means such as a rod.

4 Claims, 1 Drawing Sheet

DIPOLE FOR MAGNETIC FIELD COMPENSATION

GOVERNMENT INTEREST

The invention described herein maybe manufactured, used and licensed by or for the Government of the United States of America for governmental purposes without the payment to me of any royalty thereon.

TECHNICAL FIELD

The present invention relates to magnetic dipoles that are utilized for the compensation of nonuniformities in transverse magnetic fields and, more particularly, to magnetic dipoles that are adjustable in order to produce any desired dipole strength.

BACKGROUND OF THE INVENTION

Currently, there are several types of devices which require a uniform transverse magnetic field for proper operation. For example, magnetic resonance imaging devices require relatively large uniform transverse magnetic fields, that is, they require fields generally above 1 kOe. Presently, superconducting magnets are used to generate these uniform fields. However, superconducting magnet structures are bulky and expensive and, therefore, attempts have been made to replace these superconducting magnet structures with permanent magnet structures. However, during the course of fabricating and assembling these permanent magnet structures, physical and magnetic defects occur. These defects create magnetic field irregularities that are greater than tolerable for the operation of the magnetic resonance images.

Recently, though, a method has been developed which compensates for these magnetic field irregularities wherein magnetic dipoles are positioned within the permanent magnet structure to reduce the deviation from the desired magnetic field to essentially zero. This is fully described in *Compensation of Non-uniform Magnetic Properties of Components of a Yokeless Permanent Magnet*, IEEE Transactions on Magnetics, Vol. 25, No. 5, pages 3904–3906, September, 1989 by Abele et al and in U.S. application Ser. No. 07/587,285, filed Sept. 24, 1990, entitled, "COMPENSATION FOR MAGNETIC NON-UNIFORMITIES OF PERMANENT MAGNET STRUCTURES", which is incorporated herein by reference. This method employs magnetic dipoles that are placed in symmetrical arrays about the cavity axis of the magnetic structure. Because each magnetic structure typically is composed of sectional slices of permanent magnetic material, the magnetic field of each slice needs to be mapped with Hall probes or other field meters and compared with the desired fields. Then, the dipole strength and orientation for each slice is determined from the measured field deviations as more fully explained in the above noted references. Thereafter, the dipoles are symmetrically placed in each slice as calculated.

Since permanent magnet structures are generally composed of several slices of permanent magnetic material, several dipoles of varying strengths must be employed. Obviously then, custom made magnets would be prohibitive on a mass production basis and therefore, it is desirable to manufacture a single adjustable magnet that can be set to any desired dipole strength and orientation. The present invention offers such a magnet.

SUMMARY OF THE INVENTION

It is an objective of the present invention to provide a magnet that is capable of being adjusted to any dipole strength.

It is another objective of the present invention to provide a dipole that is easily adjustable in strength and orientation in order to compensate for nonuniformities in permanent magnet structures which produce transverse magnetic fields.

The above and other objects are achieved in accordance with the present invention by the use of a permanent magnet which is generally spherical in shape and which is surrounded by another magnet which forms a shell around the spherical magnet. In its preferred embodiment the present invention is comprised of two concentric, uniformly magnetized spherical shells of equal dipole moment. The outer shell is provided with a thin slit along a meridian of longitude, thereby providing access to the inner shell or sphere in order to rotate the inner shell or sphere with respect to the outer shell. Ideally, this rotation is done by a non-magnetic means such as a rigid non-magnetic rod protruding axially from one of the inner shell's poles. This rod, then, is used as a lever to rotate the inner sphere so that its polar axis could have any orientation 0 with respect to the axis of the outer shell between $0=0°$ to $180°$. By rotating the inner shell within the outer shell any dipole moment, p, between $p=0$ and $p=2q$ (where q is the dipole moment of either single shell alone) can be obtained. Thus, the present invention provides for an adjustable dipole strength which can correct the largest fabrication errors given sufficient dipole moment of the magnetic shells used.

BRIEF DESCRIPTION OF THE DRAWING

The invention will be more fully appreciated from the following detailed description when the same is considered in connection with the accompanying drawing in which.

DETAILED DESCRIPTION

Figure 1:
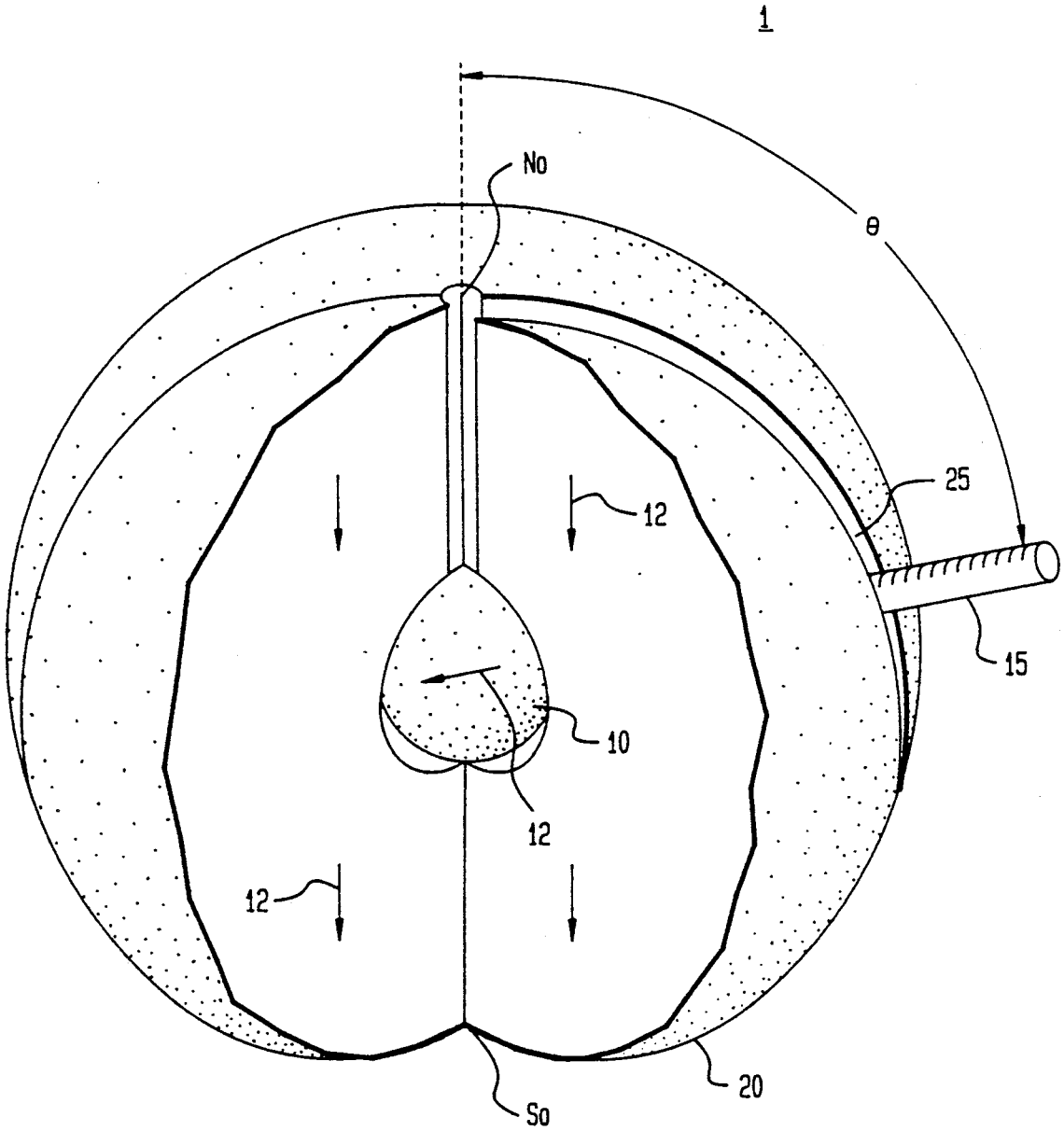
FIG. 1 is a perspective view of one embodiment of the present invention.

As shown in FIG. 1, the present invention comprises an inner magnetic sphere 10 which is rotatably mounted within outer magnetic shell 20. Outer magnetic shell 20 has a longitudinal thin slit 25 which provides space through which rigid non-magnetic rod 15 may move. Rod 15 is fixably attached to inner magnetic sphere 10 so that rod 15 may be used as a lever to rotate inner magnetic sphere 10 at an angle $\sigma$ within outer magnetic shell 20. Slit 25 should be large enough to permit the inner sphere to rotate with respect to the axis of the outer sphere between $\sigma=0°$ to $180°$. This will allow the present invention to have any value of dipole moment, p, between $p=0$ to $p=2q$ where q is the dipole moment of either the sphere 10 or the shell 20 alone. The dipole moment of either the sphere 10 or the shell 20 must therefore be made sufficiently large to produce a dipole strength that will compensate for the largest fabrication errors in the MRI source.

Generally, the dipole moment of a spherical shell is:

$$q=BrV;$$

where Br is the magnetization of either the shell 10 or the sphere 20 (or the remanence for a perfect Rare Earth Permanent Magnet (REPM)) and V is the volume of either the sphere 10 or the shell 20. Therefore, if q is to be half the maximum of any undesirable magnetic field deviation or Pmax, then the magnetization of the shell or the sphere should have the highest remanence available and the spherical volume should be at a minimum. Mathematically, this can be expressed as:

$$Pmax/2Br = V = 4\pi/3[Ro^3 - Ri^3] = 4\pi/3[Ri^3 - Rc^3]$$

where Ro, Ri and Rc are equal to the outer radius of the outer shell 20, the inner radius of the outer shell 20, and the inner radius of the inner sphere, respectively. For minimum volume Rc is obviously 0 and $Ri^3 = Ro^3/2$, so that $$4\pi Ro^3/3 = Pmax/2Br;$$

$$Ro = \sqrt[3]{3Pmax/4\pi Br}\ ; \text{ and}$$

$$Ro = (3Pmax/4\pi Br)$$

Given the highest dipole moment, then, any value of dipole moment, p, of the entire structure between p=0 and p=2q can be obtained by rotating inner magnetic sphere 10 within outer magnetic shell 20. P will equal zero when the orientation and magnitude of the magnetizations are directly opposed and the volumes of the inner sphere 10 and the outer shell 20 are equal and p will equal 2q when the orientation and magnitude of the magnetizations of sphere 10 and shell 20 are aligned in parallel and their volumes are equal.

Obviously, inner sphere 10, in order to be rotatably mounted within outer shell 20, must be at least as small as the hollow cavity in outer shell 20. Preferably, inner sphere 10 is large enough to be fitted snugly within outer shell 20.

Inner sphere 10 may be formed by general machining practices of those skilled in the magnetic arts. Likewise, outer shell 20 may be formed by machining two identical halves of a substantially spherical shell. Prior to assembly of dipole 1, inner sphere 10 is uniformly magnetized in a single direction as shown by arrows 12. The two identical halves of outer shell 20 are also magnetized uniformly in a single direction. Slit 25 may be machined prior to or after magnetization of outer shell 20. After magnetization of both inner sphere 10 and outer shell 20, inner sphere 10 is placed within the two halves of outer shell 20 to form dipole 1. Outer shell 20 may be secured around inner shell 10 by any means such as an epoxy.

As explained earlier, when inner shell 10 is rotated within shell 20 via a non-magnetic means such as rod 15 attached to a magnetic pole, No or So, of sphere 10, the dipole strength of dipole 1 is either increased or decreased depending on the direction of rotation and the initial magnetization of inner sphere 10 and shell 20. Once the inner sphere is rotated such that the dipole 1 is of desired strength the inner sphere may be fixed at a particular angle of rotation by an epoxy or other means. It is anticipated that the epoxy securing the two halves of outer shell 20 together may further secure the angle of rotation of the inner sphere. This may be accomplished by assembling the dipole 1 just prior rotating the inner dipole and by providing sufficient epoxy along the two halves of outer shell 20 to seep in the inner cavity of outer shell 20.

The magnetic material of the segments of the dipole may be comprised of Nd2 Fel4B, Sm Co5, PtCo5Sm2-(CoT)17 where T is one of the transition metals. The foregoing material are characterized by the fact that they maintain their full magnetization to fields larger than their B coercivities. These and other equivalent magnetic materials are well known to those skilled in the art. Accordingly, it is to be understood that the principles of the present invention are in no way limited to the magnetic material selected for the segments. Also, as known to those skilled in the art, the segments can be pressed to the appropriate shape and magnetized in the desired orientation using any of the known magnetization techniques.

Other and different approximations obviously exist for the invention described above and accordingly, having shown and described what is at present considered to be one embodiment of the invention, it should be understood that the same has been shown by way of example and not limitation. Therefore, all modifications, alterations and changes coming within the spirit and scope of the invention are means to be included herein.

What is claimed is:

1. A magnetic dipole of varying dipole magnitude comprising:

an outer magnetic shell made of magnetically rigid material, said outer magnetic shell being magnetized in a uniform direction and magnitude and having a central cavity there within;

an inner magnetic sphere made of magnetic rigid material, said inner magnetic sphere being magnetized in a uniform direction and magnitude and being rotatably mounted in the central cavity of the outer magnetic shell; and means to rotate the inner magnetic sphere within the outer magnetic shell.

2. A magnetic dipole as described in claim 1 which further comprises means to secure the inner magnetic sphere within the outer magnetic shell.

3. A magnetic dipole as described in claim 1 wherein the outer magnetic shell has a slit and the means to the rotate the inner magnetic sphere within the outer magnetic shell is a non-magnetic rod attached to the inner sphere through the slit.

4. A magnetic dipole as described in claim 1 wherein the inner sphere and outer shell are comprised of a rigidly magnetic material selected from the group of Nd2 Fel4B, Sm Co5, PtCo5, Sm2(CoT)17 where T is one of the transition metals.

* * * * *